US005986520A

United States Patent [19]

Abeno et al.

[11] Patent Number: 5,986,520

[45] **Date of Patent: *Nov. 16, 1999**

[54] FILTER APPARATUS WITH CIRCULATOR FOR USE IN RADIO APPARATUS TRANSMITTING OR RECEIVING SYSTEMS

[75] Inventors: Ichiro Abeno; Kenichi Kudo, both of Kawasaki; Kiyokazu Sugai, Sendai, all of Japan

[73] Assignee: Fujitsu Limited, Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/604,559

[22] Filed: Feb. 21, 1996

[30] Foreign Application Priority Data

Aug. 11, 1995 [JP] Japan ..... 7-206255

[51] Int. Cl.[6] ..... H01P 5/12; H01P 1/20; H01P 7/10

[52] U.S. Cl. ..... 333/134; 333/202; 333/234

[58] Field of Search ..... 333/202, 202 DR, 333/212, 219.1, 234, 126, 129, 134, 135

[56] References Cited

U.S. PATENT DOCUMENTS

| | | | |
|---|---|---|---|
| 4,121,181 | 10/1978 | Nishikawa et al. | 333/202 |
| 5,087,902 | 2/1992 | Hyuga et al. | 333/234 X |
| 5,546,057 | 8/1996 | Pfitzenmaier | 333/134 |

FOREIGN PATENT DOCUMENTS

| | | | |
|---|---|---|---|
| 0209878 | 1/1987 | European Pat. Off. | 333/202 DR |
| 0144988 | 11/1980 | Germany | 333/134 |
| 0157201 | 9/1983 | Japan | 333/134 |
| 0013801 | 1/1986 | Japan | 333/134 |

*Primary Examiner*—Robert Pascal
*Assistant Examiner*—Barbara Summons
*Attorney, Agent, or Firm*—Helfgott & Karas,P.C.

[57] ABSTRACT

Disclosed are a filter apparatus for use in a radio apparatus for multiplex radio communication used when a signal is branched, a jig for arranging dielectrics of the filter apparatus for use in a radio apparatus and a method for arranging dielectrics of the filter apparatus for use in a radio apparatus using the jig. A filter apparatus for use in a radio apparatus has a pair of dielectric filters having different frequency characteristics, which are connected to a common circulator, thereby reducing the number of the circulators to realize a reduction of size and a low cost of the radio apparatus and improvement of accuracy in communication.

22 Claims, 21 Drawing Sheets

FILTER APPARATUS WITH CIRCULATOR FOR USE IN RADIO APPARATUS TRANSMITTING OR RECEIVING SYSTEMS

BACKGROUND OF THE INVENTION (1) Field of the Invention

The present invention relates to a filter apparatus for use in a radio apparatus for multiplex radio communication used when a signal is branched, a jig for arranging dielectrics of the filter apparatus for use in a radio apparatus, and a method for arranging dielectrics of the filter apparatus for use in a radio apparatus using the jig.

(2) Description of Related Art

As shown in FIG. 18, a multiplex radio apparatus 100 for multiplex radio communication has, in general, a high-frequency transmitting unit 110 for converting signals into RF signals as high-frequency input signals suitable for being transmitted by place propagation and transmitting the signals, a high-frequency receiving unit 120 for receiving the RF signals transmitted by the high-frequency transmitting unit 110 and demodulating the signals, a transmitting-receiving multiplexer 129, and an antenna 130.

The high-frequency transmitting unit 110 transmits signals from plural transmitting systems (FIG. 18 shows only a first transmitting system 110A and a second transmitting system 110B). The first transmitting system 110A has a modulating unit (MOD) 111A, an up-converter (U/C) 117A, and an amplifier 114A. The second transmitting system 110B has a modulating unit (MOD) 111B, an up-converter (U/C) 117B, and an amplifier 114B.

The up-converter 117A has a mixing circuit 112A and a voltage-controlled oscillator (VCO) 113A. The up-converter 117B has a mixing circuit 112B and a voltage-controlled oscillator (VCO) 113B.

The first transmitting system 110A and the second transmitting system 110B are connected to circulators (CIRs) 116A and 116B, respectively, via a filter bank 115.

The filter bank 115 removes unnecessary wave components in the RF signals inputted from the amplifiers 114A and 114B. The circulators 116A and 116B each have several terminals (two or three terminals in FIG. 18), transmitting an RF signal received through a certain terminal to an adjacent terminal in a specific direction to prevent a reverse travel of the signal in the transmission.

In the high-frequency receiving unit 120, any one of plural receiving systems (FIG. 18 shows only a first receiving system 120A and a second receiving system 120B) receives a signal according to a frequency characteristic of the received signal. The first receiving system 120A has a demodulating unit (DEM) 121A, a down-converter (D/C) 127A, a low noise amplifier (LNA) 124A. The second receiving system 120B has a demodulating unit (DEM) 121B, a down-converter (D/C) 127B, a low noise amplifier (LNA) 124B.

The down-converter 127A has a mixing circuit (a frequency converting circuit) 122A and a voltage-controlled oscillator (VCO) 123A. The down-converter 127B has a mixing circuit 122B and a voltage-controlled oscillator (VCO) 123B.

The first receiving system 120A and the second receiving system 120B are connected to circulators (CIRs) 126A and 126B, respectively, via a filter bank 125.

The circulators 126A and 126B each have several terminals (two or three terminals in FIG. 18) similar to the circulators 116A and 116B, transmitting an RF signal received through a certain terminal to an adjacent terminal in a specified direction. The RF signal as a received signal inputted through the antenna 130 and the transmitting-receiving multiplexer 129 is transmitted toward the circulator 126B from the circulator 126A.

The filter bank 125 removes unnecessary wave components of the RF signals as received signals inputted through the antenna 130 and the transmitting-receiving multiplexer 129. The filter bank 125, at the same time, branches the received signal according to a frequency characteristic of the signal and transmits the signal to either the first receiving system 120A or the second receiving system 120B.

In the multiplex radio apparatus 100 with the above structure shown in FIG. 18, an RF signal is transmitted through the high-frequency transmitting unit 110, the transmitting-receiving multiplexer 129 and the antenna 130 when the signal is transmitted. On the other hand, the RF signal is received through the antenna 130 and the transmitting-receiving multiplexer 129 in the multiplex radio apparatus on the receiver side. The received RF signal is branched in the filter bank 125 according to a frequency characteristic of the signal, and transmitted to either the first receiving system 120A or the second receiving system 120B.

In practice, the high-frequency receiving unit 120 has, as shown in FIG. 19, a branching filter 131 for receiving signals which has plural circulators (CIRs) 132 through 136 and the filter bank 125 including plural dielectric filters 137 through 141. Incidentally, FIG. 20 shows the circulators 132 and 133, and the dielectric filters 137 and 138 shown in FIG. 19.

Namely, the branching filter 131 used in the mutliplex radio apparatus has n circulators and n dielectric filters in the case of n branches. Incidentally, a TE01δ mode dielectric filter, which has a small loss of a high-frequency signal, is used as the dielectric filter.

In the high-frequency receiving unit 120 shown in FIG. 19, a microwave signal (which has various frequency components $f_1$ through $f_n$) as a received signal (an RF signal) received by the antenna 130 is inputted from a port 0 to the branching filter 131.

The inputted microwave signal is inputted to the dielectric filter 137 having a pass frequency band of a frequency $f_1$ via the circulator 132. The microwave signal having a frequency $f_1$ then passes through the dielectric filter 137, and is outputted to a port 1. On the other hand, the microwave signal having frequencies $f_2$ through $f_n$ is reflected by the dielectric filter 137, then inputted to the dielectric filter 138 having a pass frequency band of a frequency $f_2$ via the circulators 132 and 133.

In the dielectric filter 138, only the microwave signal having a frequency $f_2$ is allowed to pass through the dielectric filter 138 and outputted to a port 2. The remaining microwave signal having frequencies $f_3$ through $f_n$ is reflected by the dielectric filter 138, and inputted to the dielectric filter 139 having a pass frequency band of a frequency $f_3$ via the circulators 133 and 134.

Likewise, in the dielectric filter 139, only the microwave signal having a frequency $f_3$ is allowed to pass through the dielectric filter 139, and outputted to a port 3. In the dielectric filter 140 having a pass frequency band of a frequency $f_4$, only the microwave signal having a frequency $f_4$ is allowed to pass through the dielectric filter 140, and outputted to a port 4. This process is repeated. In the dielectric filter 141 having a pass frequency band of a frequency $f_n$, only the microwave signal having a frequency $f_n$ is allowed to pass through the dielectric filter 141, and outputted to a port n.

As above, the branching filter 131 branches the microwave signal to the ports 1 through n by means of the dielectric filters 137 through 141 having the respective pass frequency bands of $f_1$ through $f_n$. In other words, if a pass frequency of a filter of the ith port is $f_i$, a microwave signal having a frequency $f_i$ appears at this port.

Incidentally, the branching filter 131 is grounded via a terminal resistor 142.

Since the general branching filter 131 as above uses circulators and filters as many as branches, the general branching filter 131 has drawbacks that a space for mounting the branching filter 131 increases and it is difficult to reduce a cost of the branching filter 131.

When the microwave signal inputted through the port 0 is outputted to the port 2 after inputted to the dielectric filter 137, the microwave signal passes the circulator 132 twice, as shown in FIG. 21. Namely, the microwave signal branched to the ith port passes through the circulator 132 (2i −1) times.

However, a loss generated when the microwave signal passes the circulator once is from 0.1 to 0.2 dB. If the number of the circulators increases, the number of times the microwave signal passes through the circulators also increases. In consequence, the general branching filter has another drawback that a loss generated when the microwave passes through the circulators increases.

With an increase of a loss generated when the microwave signal passes through the circulators, noise components in the microwave signals increases, as well. For this, a ratio of signal components to noise components (an S/N ratio) of the branched microwave signal increases, which leads to a degradation of accuracy in the communication.

SUMMARY OF THE INVENTION

In the light of the above problems, an object of the present invention is to reduce the number of circulators in a simple structure, realize a reduction of size and a low cost of the apparatus, and improve accuracy in communication. To this end, the present invention provides a filter apparatus for use in a radio apparatus, a jig for arranging dielectrics of the filter apparatus for use in a radio apparatus and a method for arranging dielectrics of the filter apparatus for use in a radio apparatus using the jig.

The filter apparatus for use in a radio apparatus according to this invention has a pair of dielectric filters having different frequency characteristics, which are connected to a common circulator.

The filter apparatus for use in a radio apparatus according to this invention has an advantage of reducing the number of the dielectric filters and the number of boxes for the circulators by half, thereby realizing a smaller size and a low cost of the filter apparatus for use in a radio apparatus, and realizing a highly accurate communication by preventing attenuation of a radio transmitted-received signal occurring when the signal passes through the circulators.

In the filter apparatus for use in a radio apparatus according to this invention, the pair of dielectric filters may be connected to the common circulator via a T-shaped branching unit.

In consequence, the filter apparatus for use in a radio apparatus of this invention has an advantage of reducing the number of the circulators by half while using dielectric filters having been employed in a general radio apparatus, thereby realizing a smaller size and a low cost of the filter apparatus for use in a radio apparatus, and highly accurate communication by preventing attenuation of a radio transmitted-received signal occurring when the signal passes through the circulators.

The filter apparatus for use in a radio apparatus according to this invention has a part of dielectric filters having different frequency characteristics formed in left and right portions of the box by arranging plural dielectrics at certain clearances in a substantially linear array within the box, a middle position input-output member protruding into a middle portion within the box and connected to a circulator, and end position input-output members protruding into end portions within the box.

According to the filter apparatus for use in a radio apparatus of this invention, the pair of dielectric filters may use commonly the middle position input-output member. This structure has an advantage that the structure of a connecting portion between the box and the middle position input-output member and a method for connecting the box and the middle position input-output member remain similar to those of general dielectric filters to readily realize integration of the circulator and the dielectric filters.

In the filter apparatus for use in a radio apparatus according to this invention, the box may be formed integrally with a box for the circulator.

In consequence, the filter apparatus for use in a radio apparatus of this invention does not need a connector between the circulator and the dielectric filters, thereby removing a loss of a radio transmitted-received signal generated when the signal passes due to insertion of the connector.

Further, the filter apparatus for use in a radio apparatus according to this invention has a box having an oblong space therein, a dielectric filter formed in a half portion of the box in which plural dielectrics are arranged at certain clearances in a substantially linear array, a middle position input-output member protruding into a middle portion within the box and connected to a circulator, and an end position input-output member protruding into an end potion within the box.

In the filter apparatus for use in a radio apparatus of this invention, it is possible to employ a structure of a connecting unit between the box and the middle position input-output member and a method for connecting the box and the middle position input-output member similar to those of the general dielectric filters, thereby readily realizing integration of the circulator and the dielectric filters. In addition, it is also possible to use the same box in either case where the filter apparatus includes one dielectric filter which does not make a pair or the filter apparatus includes two dielectric filters which make a pair. It is thus possible to apply the same box if the filter for use in a radio apparatus includes dielectric filters in odd numbers.

In the filter apparatus for use in a radio apparatus according to this invention, it is preferable that the above-mentioned dielectric filter is configured with a TE01δ mode dielectric filter.

Accordingly, the filter apparatus for use in a radio apparatus of this invention has an advantage of reducing a loss of a high-frequency signal.

In the filter apparatus for use in a radio apparatus of this invention, the middle position input-output member may be configured with a connecting rod of an open probe. Further, the end position input-output member may be configured with a connecting rod of an open probe. Still further, the end position input-output member may be configured with an L-shaped connecting rod.

In consequence, the filter apparatus for use in a radio apparatus of this invention has an advantage of realizing reliable input-output of signals with a simple structure without using special members since the middle position input-output member and the end position input-output members are connecting rods of open probes. The filter apparatus for use in a radio apparatus of this invention has another advantage that it is possible to connect another members constituting the radio apparatus in a transversal direction of the filter apparatus for use in a radio apparatus since the end position input-output member is an L-shaped connecting member.

The box may be a tubular-shaped box. Alternatively, the box may be formed with plates. Still alternatively, the box may be fabricated in extruding work.

If the box has a tubular shape, a screw used when a cap member of the box is attached becomes unnecessary, whereby a structure of the box becomes simple and it becomes possible to reduce a size of the box. If the box is formed with plates, it is possible to reduce a cost of the box. If the box is fabricated in extruding work, a screw used when a cap member of the box is attached becomes unnecessary, whereby fabrication of the box becomes easy and a size of the box may be reduced.

Further, in the filter apparatus for use in a radio apparatus of this invention, it is possible to set a temperature coefficient at a resonance frequency of the dielectrics and a thermal expansion coefficient of the box are so set as to set a temperature coefficient of a filter to zero.

In consequence, the filter apparatus for use in a radio apparatus of this invention has another advantage of improving a branching property of the filter apparatus for use in a radio apparatus to accomplish highly accurate communication.

A jig for placing dielectrics of a filter apparatus for use in a radio apparatus according to this invention has a jig body slidable within a box both ends of which are opened, in which plural recesses are formed at certain clearances in a substantially linear array to mount dielectrics thereon, and a stopper member engaging with a protruding member attached to the box to position the jig in order to arrange plural dielectrics within the box of the filter apparatus for use in a radio apparatus that should have dielectric filters each formed by arranging the plural dielectrics at certain clearances in a substantially linear array within the box.

In consequence, the jig for arranging dielectrics of a filter apparatus for use in a radio apparatus of this invention has an advantage of arranging the dielectrics in accurate positions, thereby fabricating a dielectric filter having a high branching accuracy.

A method for arranging dielectrics of a filter apparatus for use in a radio apparatus using a jig according to this invention comprises the steps of, for the purpose of arranging plural dielectrics within a box of a filter apparatus for use in a radio apparatus that should have a dielectric filter formed by arranging the plural dielectrics at certain clearances in a substantially linear array within the box, forming plural recesses on which dielectrics are mounted at certain clearances in a substantially linear array in a body of a jig, said jig being slidable within a box both ends of which are opened forming the filter apparatus for use in a radio apparatus, and preparing the jig served to arrange the dielectrics for the filter apparatus for use in a radio apparatus having a stopper member engaging with a protruding member attached to the box to position the jig, inserting the jig into the box both ends of which are opened in a condition where the plural dielectrics are mounted on the plural recesses used to be mounted the dielectrics thereon formed in the jig body of the jig, moving forward the jig into the box until the stopper member of the jig strikes into the protruding member attached to the box, and turning the box 180° in the above condition to disconnect the dielectrics from the jig body, thereby arranging the plural dielectrics at certain clearances in a substantially linear array within the box.

Accordingly, the method for arranging dielectrics of a filter apparatus for use in a radio apparatus using a jig according to this invention has an advantage of arranging the dielectrics in precise positions, thereby fabricating a dielectric filter having a high branching accuracy.

DESCRIPTION OF THE PREFERRED EMBODIMENT

Figure 1:
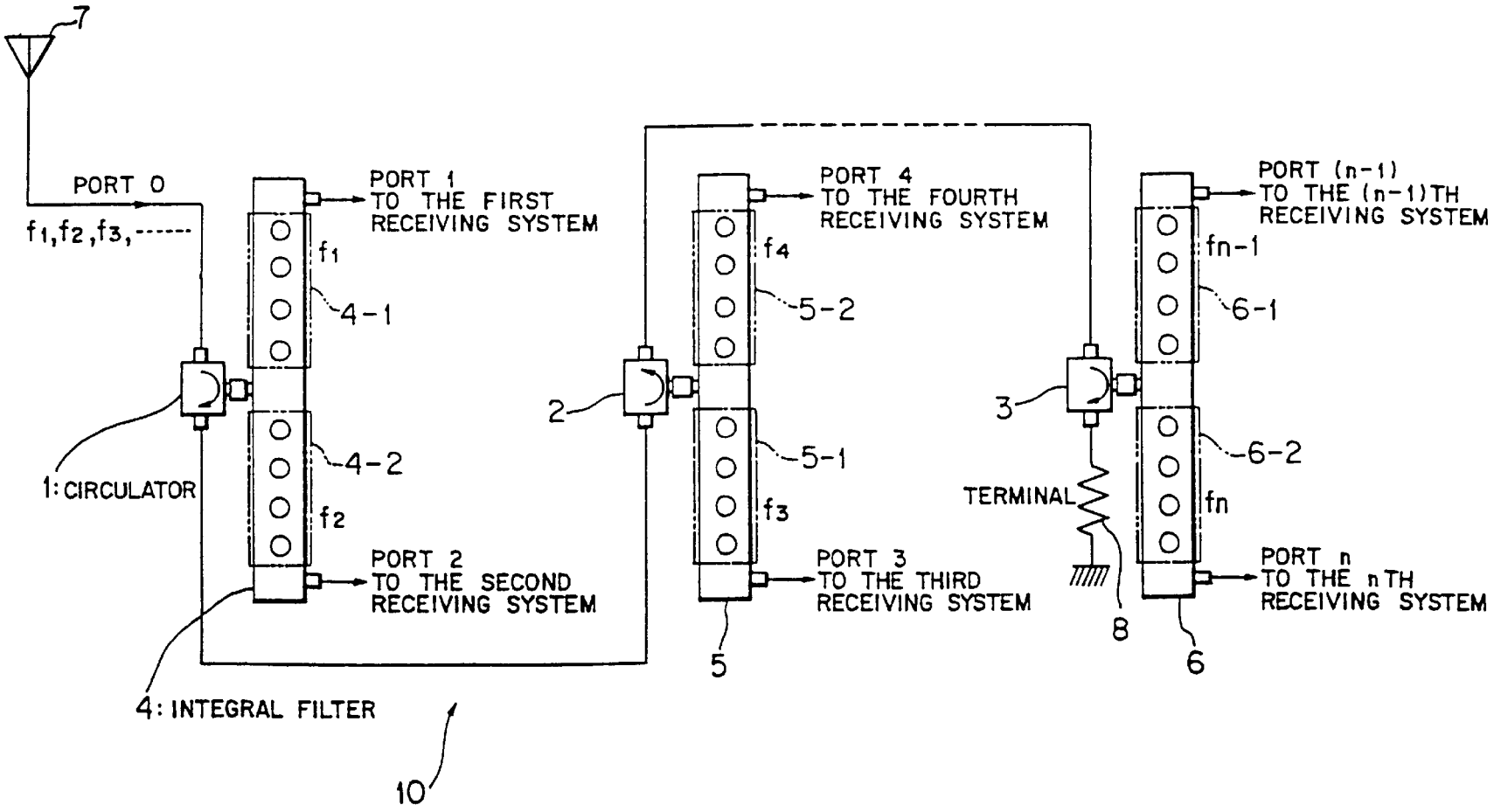
FIG. 1 shows a whole structure of a filter apparatus for use in a radio apparatus according to an embodiment of this invention.

Hereinafter, an embodiment of the present invention will be described referring to the drawings.

FIG. 1 shows a whole structure of a filter apparatus 10 for use in a radio apparatus according to an embodiment of this invention. As shown in FIG. 1, the filter apparatus 10 for use in a radio apparatus has integral filters 4 through 6 having different frequency characteristics. The integral filters 4 through 6 are connected to common circulators 1 through 3, respectively, so that the number of the circulators and the number of boxes of dielectric filters may be reduced to a half.

Namely, the number of times a microwave signal branched to the ith port of the filter apparatus 10 for use in the radio apparatus passes through the circulators is i if i is an odd number, or (i−1) if i is an even number. Accordingly, the number of times the microwave signal passes through the circulators is reduced to approximately a half, which permits a loss of the microwave signal generated when the microwave signal passes through the circulators to be reduced to a half. Incidentally, reference numeral 7 denotes an antenna and reference numeral 8 denotes a terminal resistor.

Figure 2:
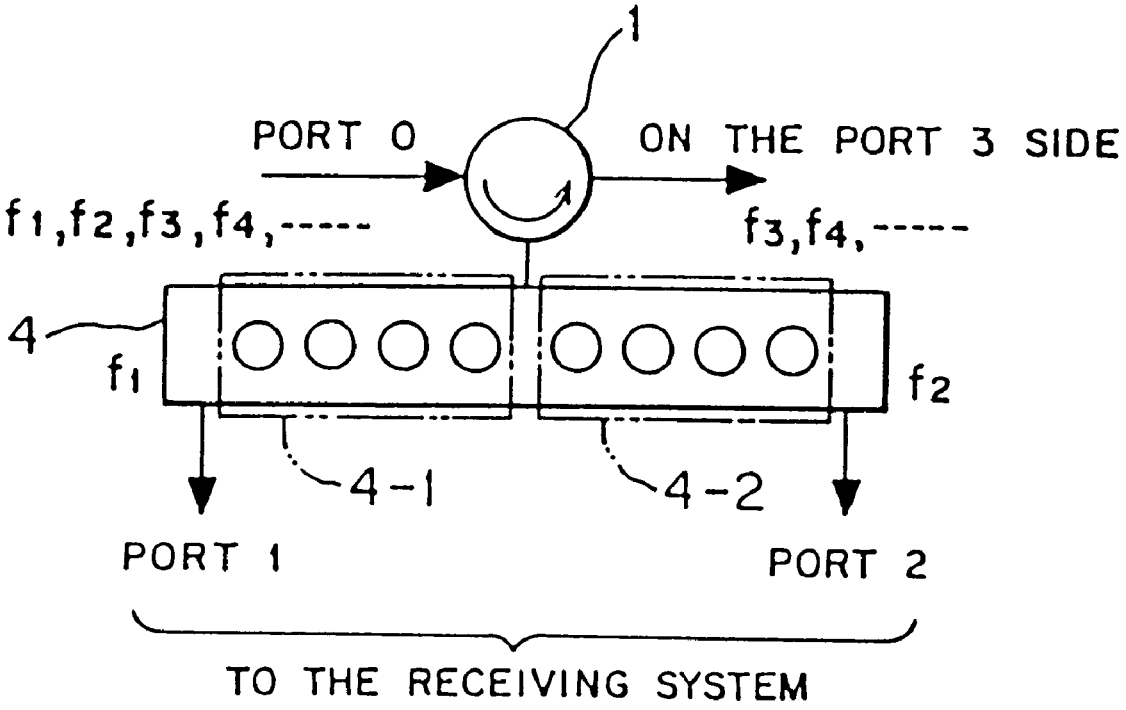
FIG. 2 shows a part of the structure of the filter apparatus for use in a radio apparatus according to the embodiment of this invention.
Figure 20:
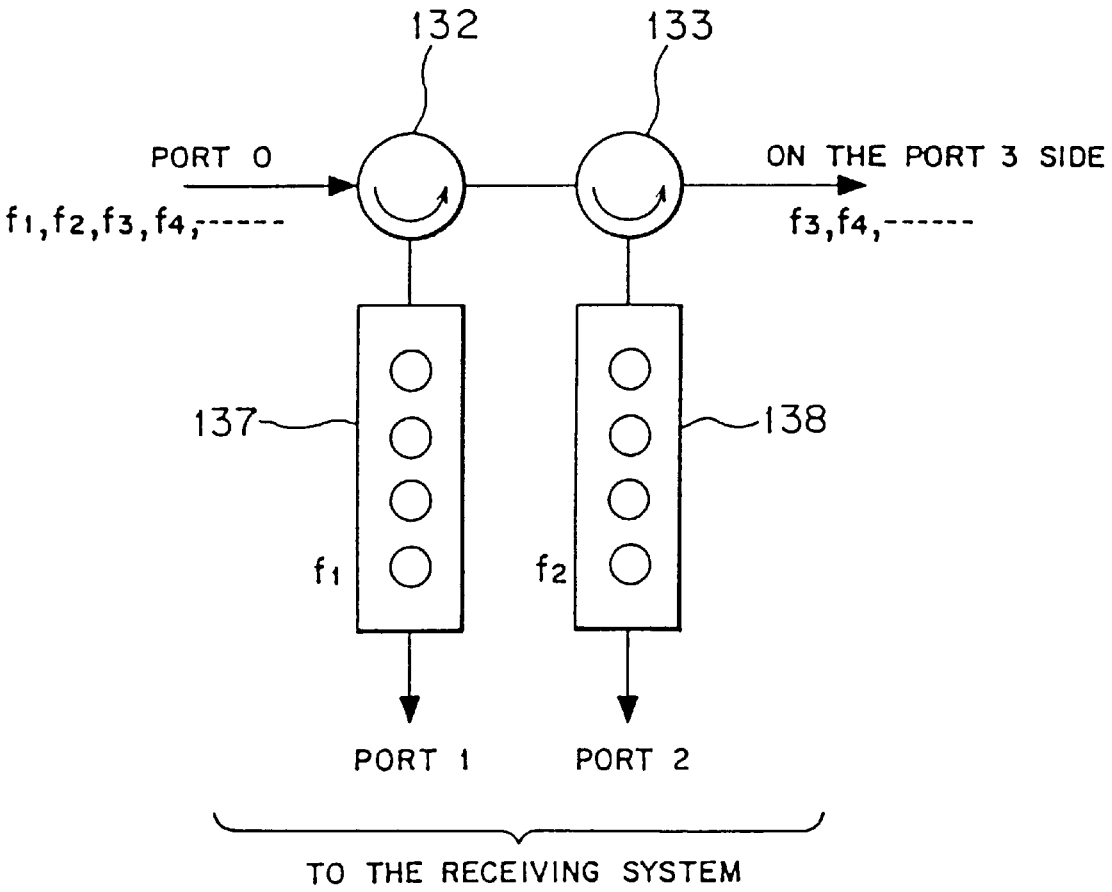
FIG. 20 RELATED ART
FIG. 20 shows a part of the structure of the high-frequency receiving unit of the general multiplex radio apparatus.
Figure 21:
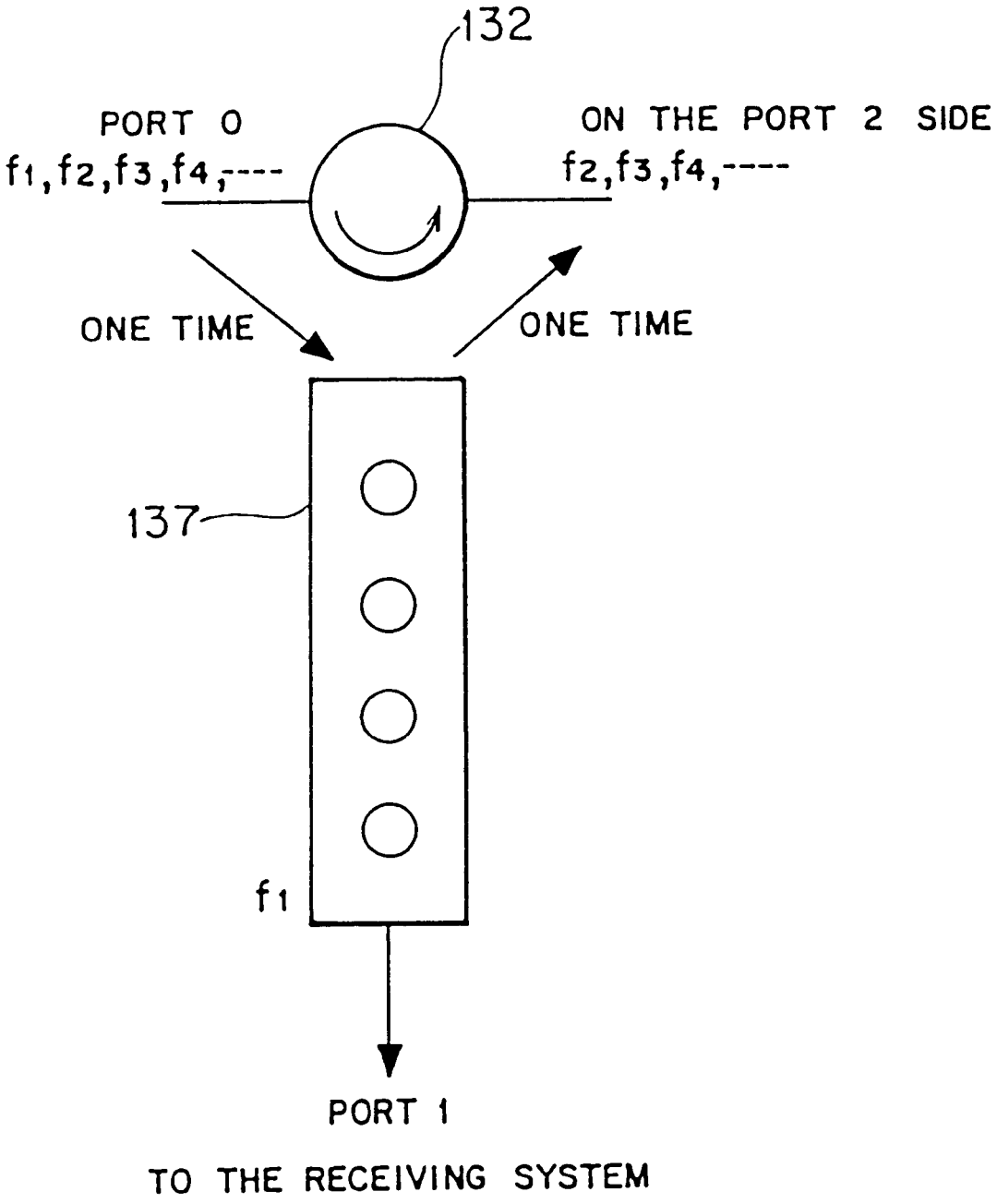
FIG. 21 RELATED ART
FIG. 21 shows a part of the structure of the high-frequency receiving unit of the general multiplex radio apparatus.

FIG. 2 shows only the integral filter 4 consisting of the circulator 1 and the dielectric filters 4-1 and 4-2 in the filter apparatus 10 for use in a radio apparatus, which corresponds to the general circulators and the general filters shown in FIG. 20.

The filter apparatus 10 for used in a radio apparatus shown in FIG. 1 is used in a high-frequency receiving unit of a radio transmitting-receiving apparatus, in which a received signal is inputted to the filter apparatus 10 for used in a radio apparatus through the antenna 7.

Sizes of the dielectrics and clearances at which the dielectric are arranged, etc. are so adjusted that the dielectric filters 4-1, 4-2, 5-1, 5-2, 6-1 and 6-2 have desired pass frequencies $f_i$, $f_2$, $f_3$, $f_4$, $f_{n-1}$ and $f_n$, respectively.

More specifically, in order that the right-head filter and the left-hand filter seen from the center in each of the integral filters 4 through 6 may have different pass frequencies, a size of the dielectrics used in the right-hand filter and a size of the dielectrics used in the left-hand filter are separately adjusted, or intervals of the dielectrics used in the right-hand filter and intervals of the dielectrics used in the left-hand filter are separately adjusted, for example.

For this, a dielectric filter adjusted at a certain frequency $f_1$ totally reflects frequencies in a band excepting its own pass frequency band so that the filter on the right side and the filter on the left side of each of the integral filters 4 through 6 do not interfere with each other.

For instance, in the integral filter 4, since $f_1$ which is one of components of the microwave signal inputted through the port 0 passes through the dielectric filter 4-1 having a pass frequency $f_1$, but is totally reflected by the dielectric filter 4-2 having a pass frequency $f_2$, the microwave signal having a pass frequency $f_1$ does not effect at all on a property of the dielectric filter 4-2.

When a microwave signal (having various frequency components $f_1$ through $f_4$) inputted through the port 0 is inputted to the integral filter 4 via the circulator 1, the microwave signal having a frequency $f_1$ is branch to the port 1 and the microwave signal having a frequency $f_2$ is branched to the port 2 by the dielectric filters 4-1 and 4-2 having the respective pass frequencies $f_1$ and $f_2$. The remaining microwave signals are reflected, outputted through the circulator 1, then inputted to the integral filter 5 via the circulator 2. The integral filter 5 has dielectric filters 5-1 and 5-2 having respective pass frequencies $f_3$ and $f_4$, whereas the integral filter 6 has dielectric filters 6-1 and 6-2 having respective pass frequencies $f_{n-1}$ and $f_n$, thereby branching the microwave signal as well as the integral filter 4.

The filter apparatus 10 for use in a radio apparatus is grounded via the terminal resistor 8. Incidentally, it is possible that the filter apparatus 10 for use in a radio apparatus is used in the high-frequency transmitting unit.

Figure 3:
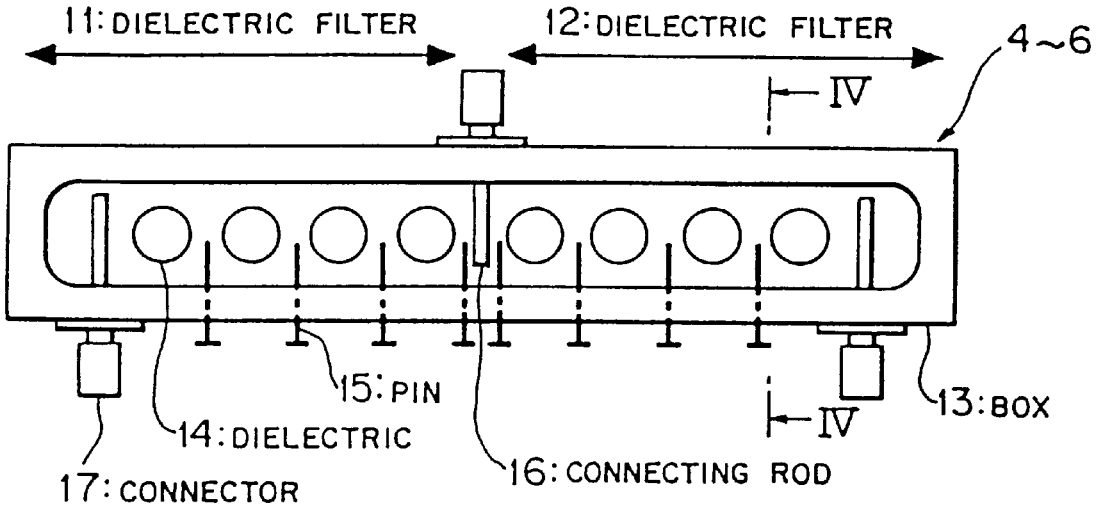
FIG. 3 shows a structure of an integral filter according to the embodiment of this invention.
Figure 4:
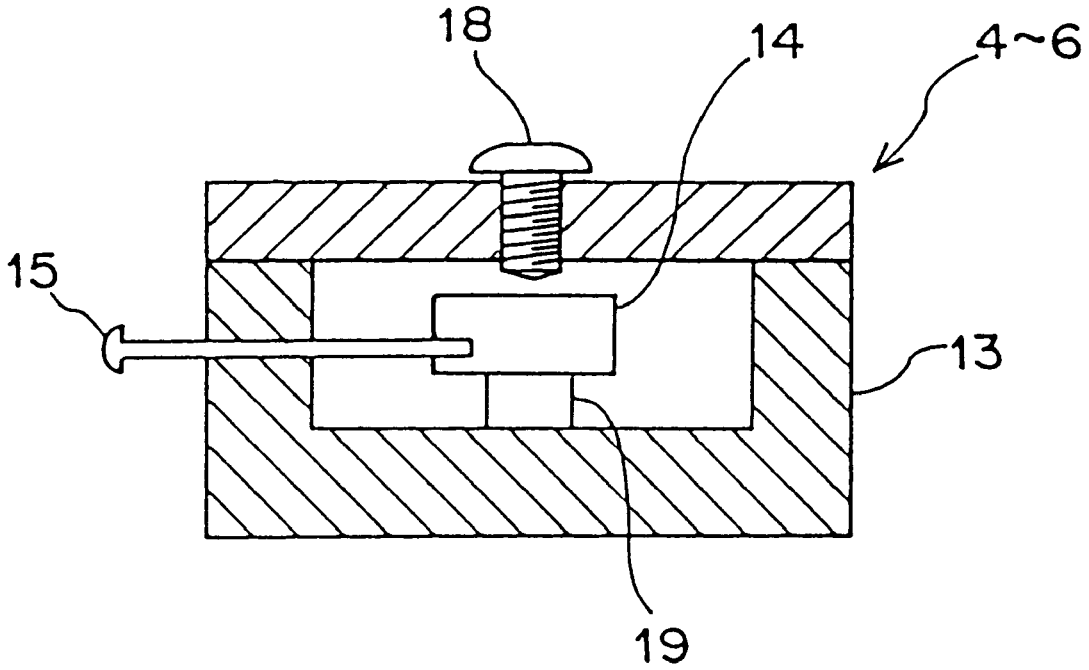
FIG. 4 is a sectional view of the integral filter taken along the line IV—IV in FIG. 3.

FIG. 3 depicts a structure of each of the integral filters 4 through 6. FIG. 4 is a sectional view of each of the integral filters 4 through 6 taken along the line IV—IV in FIG. 3.

As shown in FIG. 3, each of the the integral filters 4 through 6 has a pair of dielectric filters 11 and 12 having different frequency characteristics in the filter apparatus 10 for use in a radio apparatus. These dielectric filters 11 and 12 are connected to a common circulator 1, 2 or 3 (FIG. 1).

More specifically, each of the integral filters 4 through 6 has, as shown in FIG. 3, a box 13 which has an opening in an upper portion thereof and an oblong space therein, a pair of dielectric filters 11 and 12 having different frequency characteristics formed on the left and right sides of the box 13 within which plural dielectrics 14 (eight in FIG. 3) are arranged at certain clearances in a substantially linear array, a connecting rod 16 of an open probe which protrudes into a middle portion within the box 13 and is connected to the circulator (not shown in FIG. 3) as a middle position input-output member, connectors 17 each having a connecting rod of an open probe as an end position input-output member which protrudes into an end portion within the box 13. The connecting rod 16 is commonly used by the dielectric filters 11 and 12, thereby readily realizing integration of each of the integral filters 4 through 6 and the corresponding circulators 1, 2 or 3 although a structure of a connecting unit between the integral filters and the circulator and a method of connecting the integral filters and the circulator remain the same as those of the general filters and circulators.

A TE01δ mode dielectric filter which is a filter having a small loss of a high-frequency signal is here used as each of the integral filters 4 through 6. It is further possible that a temperature coefficient (τf) at a resonance frequency of the dielectrics 14 and a thermal expansion coefficient of the box 13 are so set that a temperature coefficient of each of the integral filters 4 through 6 is set to zero.

Further, a frequency characteristic of each of the integral filters 4 through 6 is finely adjusted by a pin 15 and a screw 18 (FIG. 4).

As shown in FIG. 4, the dielectric 14 is mounted on a support 19 in the integral filters 4 through 6.

In the integral filters 4 through 6 shown in FIG. 3, the connectors 17 are connected in a vertical direction of the box 13. However, it is alternatively possible to connect the connectors 17 in the transversal direction by using L-shaped connecting members 39 (FIG. 4) as end position input-output members so as to connect other members constituting the radio apparatus in the vertical and transversal directions of the filter apparatus 10 for use in the radio apparatus. Incidentally, it is possible to use the L-shaped connecting member on only one side of the integral filters 4 through 6.

Figure 8:
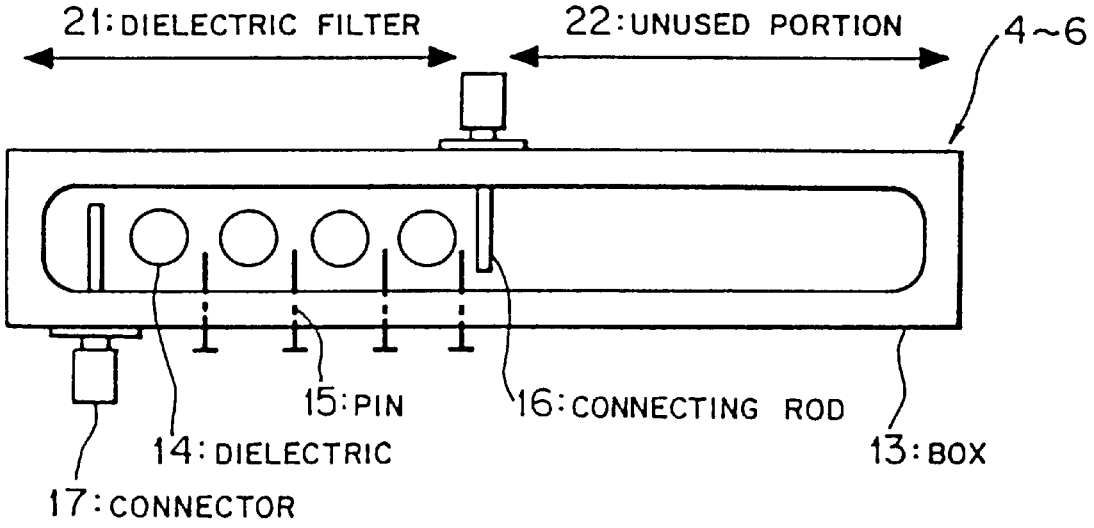
FIG. 8 shows a structure of another modified integral filter according to the embodiment of this invention.

As shown in FIG. 8, it is possible that each of the integral filters 4 through 6 has a box 13 having an oblong space therein, a dielectric filter 21 formed in a half portion of the box 13 by placing plural dielectrics 14 (four in FIG. 8) at certain clearances in a substantially linear array in a half portion (on the left side in FIG. 8) of the box 13, a connecting rod 16 of an open probe as a middle position input-output member which protrudes into a middle portion within the box 13 and is connected to a circulator (not shown in FIG. 8), and a connector 17 having a connecting rod of an open probe as an end position input-output member which protrudes into an end portion of a half portion within the box 13.

In other words, each of the integral filters 4 through 6 has the dielectric filter 21 formed by arranging the dielectrics 14 in a half portion of the box 13 and another half portion which is left unused as an unused portion 22, thereby configuring an integral filter for one channel. If the filter apparatus 10 for use in a radio apparatus has channels in odd numbers, it is possible to use the same box 13 as in an integral filter for two channels. Incidentally, distances between the dielectrics 14, distances between the connecting rod 16 and the dielectrics 14, etc. are the same as the filter apparatus for two channels.

Figure 7:
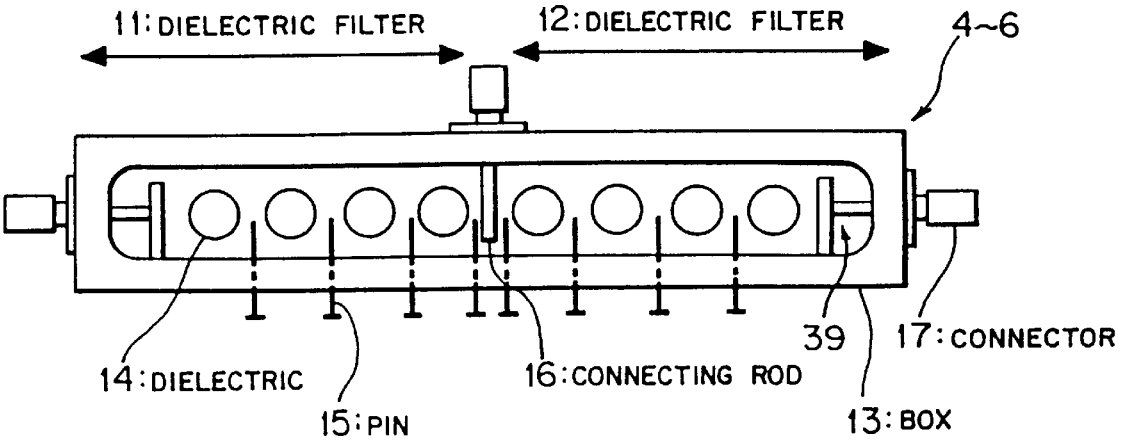
FIG. 7 shows a structure of a modified integral filter according to the embodiment of this invention.

In the integral filters 4 through 6 shown in FIG. 8, it is possible, as shown in FIG. 7, to connect the connector 17 in a transversal direction of the box 13 by using the L-shaped connecting member 39 as the end portion input-output member so as to connect other members constituting the radio apparatus in the vertical and transversal directions of the filter apparatus 10 for use in a radio apparatus.

Each of the integral filters 4 through 6 shown in FIG. 8 employs a TE01δ mode dielectric filter having a small loss of a high-frequency signal as same as the integral filters 4 through 6 shown in FIG. 3. It is possible to set a temperature coefficient (τf) at a resonance frequency of the dielectrics 14 and a thermal expansion coefficient of the box 13 so that a temperature coefficient of the filter is set to zero.

Figure 5:
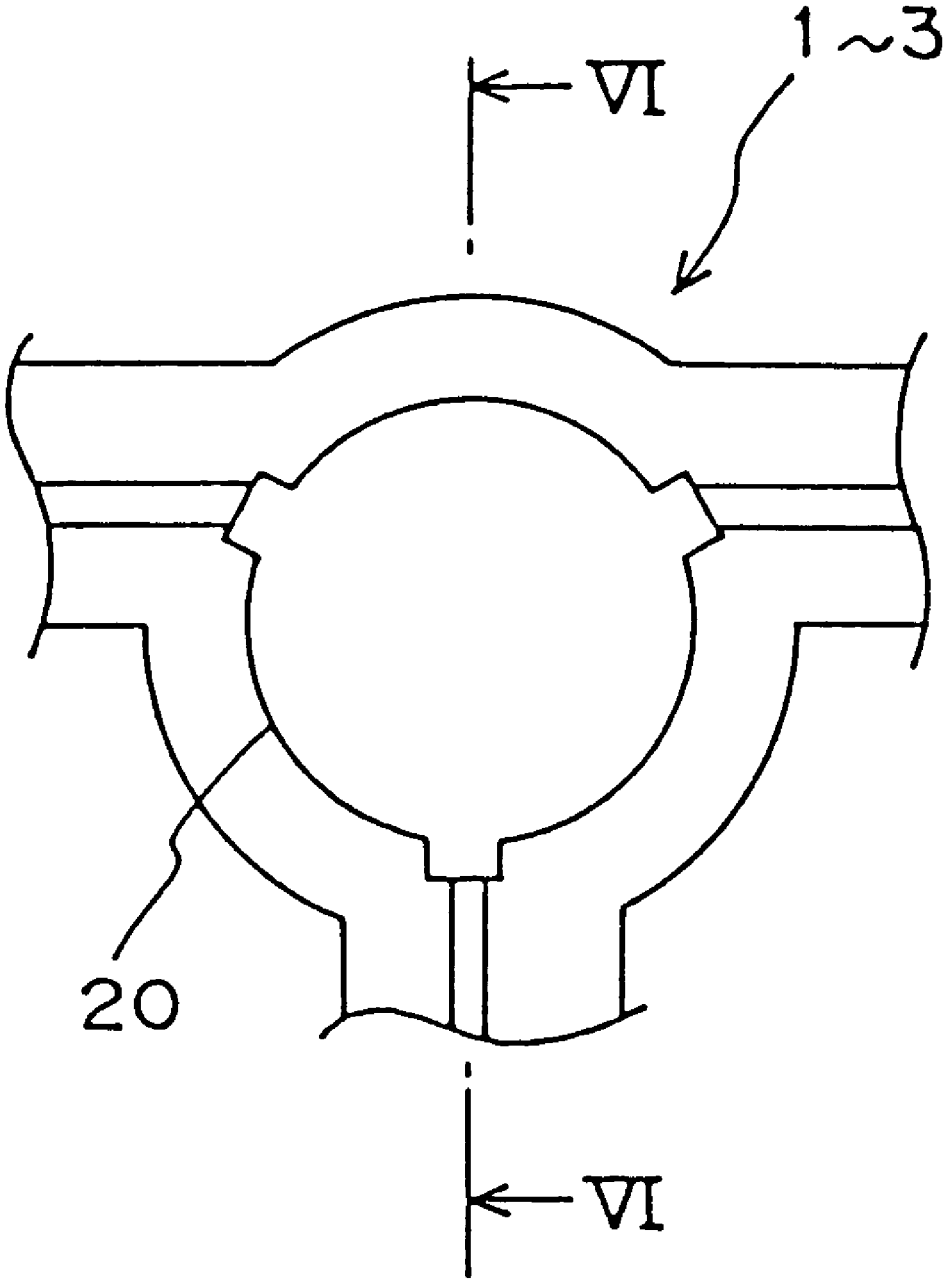
FIG. 5 is a plan view of an essential part of a circulator shown in FIG. 1.
Figure 6:
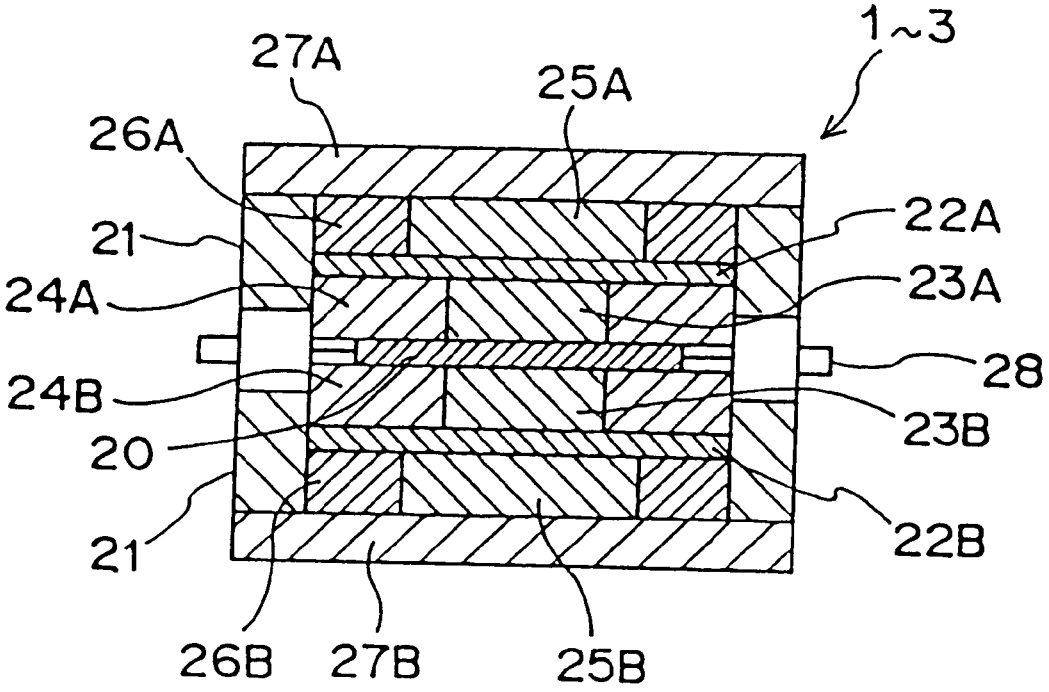
FIG. 6 is a sectional view of the circulator taken along the line VI—VI in FIG. 5.

FIG. 5 is a plan view of an essential part of each of the circulators 1 through 3 shown in FIG. 1. FIG. 6 is a sectional view taking along the line VI—VI in FIG. 5.

Each of the circulators 1 through 3 has, as shown in FIG. 5, several terminals (three terminals in FIGS. 1 and 5), which serves to transmit a microwave signal as an RF signal inputted to a certain terminal to an adjacent terminal in a specific direction. The microwave signal is transmitted from the circulator 1 toward the circulator 3.

In each of the circulators 1 through 3, a copper plate 20 connected to the several terminals (three terminals in FIGS. 1 and 5) is held between ferrite 23A and 23B, held by copper plates 22A and 22B for grounding, held by magnets 25A and 25B, finally held by cap members 27A and 27B, as shown in FIG. 6. The ferrite 23A and 23B are fixed in predetermined positions in each of the circulators 1 through 3 using positioning members 24A and 24B made of Teflon (trade name), respectively, and the magnets 25A and 25B are fixed in predetermined positions in each of the circulators 1 through 3 using positioning members 26A and 26B made of aluminum. Incidentally, reference numeral 21 denotes a circulator box, whereas reference numeral 28 denotes a signal input-output terminal.

Figure 9:
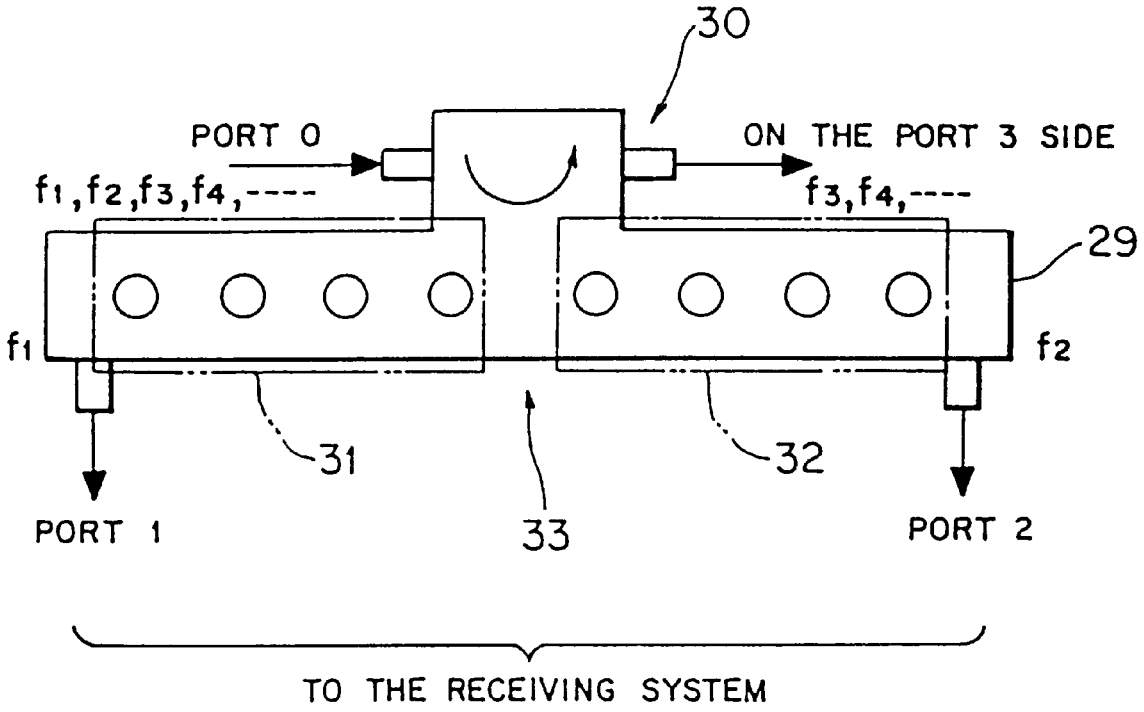
FIG. 9 shows an example of an integrated structure of the integral filter and the circulator according to the embodiment of this invention.

As shown in FIG. 9, it is also possible to form the box 29 integrally with the box 29 for the circulator and integrate the circulator 30 and a pair of dielectric filters 31 and 32 so as to realize an integral circulator-filter 33. This structure may omit a connector between the circulator 30 and the dielectric filters 31 and 32, thereby removing a loss of a microwave signal occurring when the microwave signal passes caused by insertion of the connector. Meanwhile, a frequency characteristic of the integral circulator-filter 33 shown in FIG. 9 is finely adjusted by a pin and a screw not shown.

Figure 10:
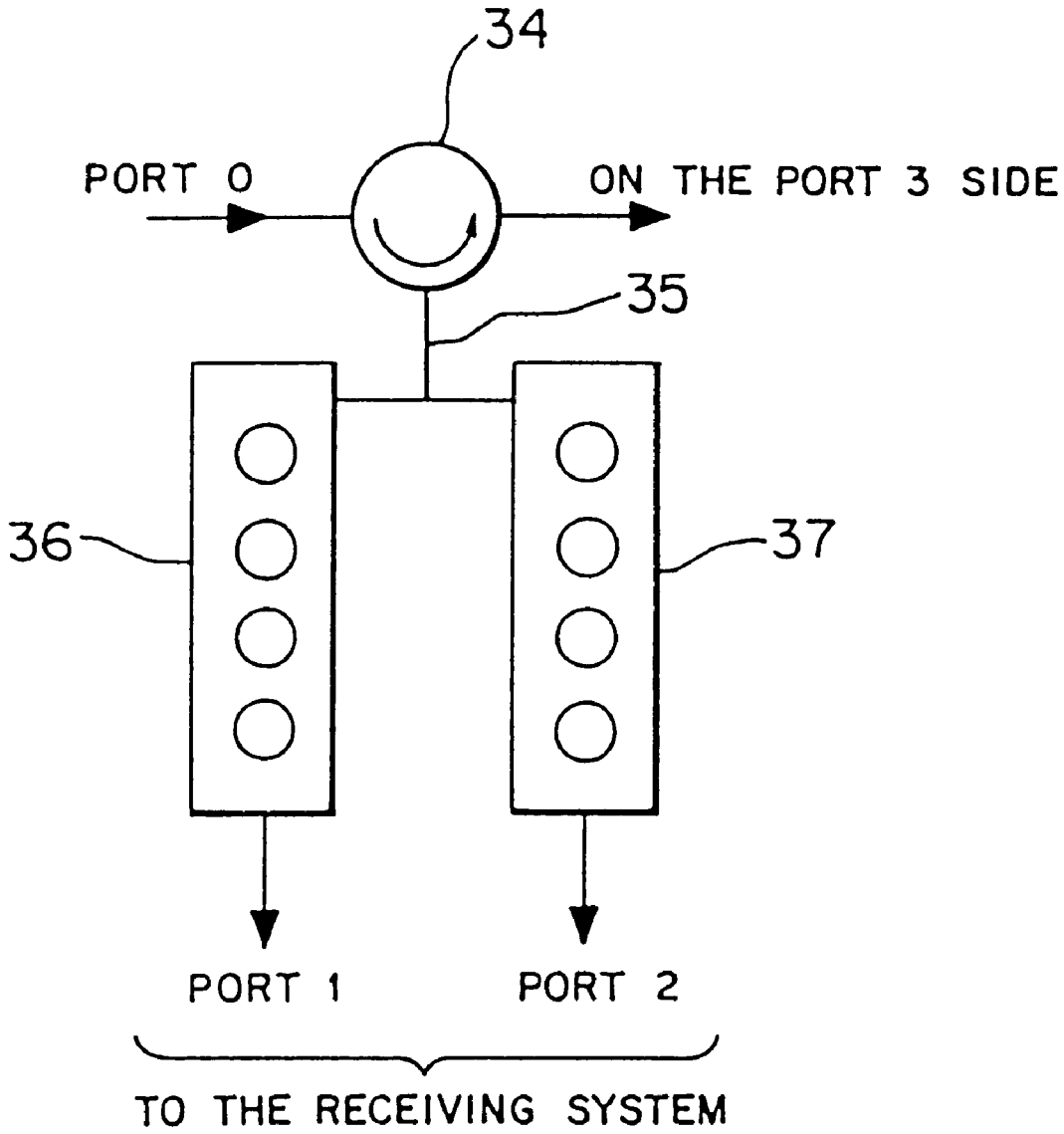
FIG. 10 shows an example where the dielectric filters and the circulator are connected to each other via a T-shaped branching unit according to the embodiment of this invention.

Further, as shown in FIG. 10, it is alternatively possible to connect a pair of dielectric filters 36 and 37 to a common circulator 34 via a T-shaped branching unit 35, thereby reducing the number of circulators to a half while the dielectric filters used in the general radio apparatus remain used. Incidentally, frequency characteristics of the dielectric filters 36 and 37 shown in FIG. 10 are finely adjusted by pins and screws not shown.

In the filter apparatus 10 for use in a radio apparatus shown in FIG. 1 with the above structure, when a microwave signal as a high-frequency signal received by the antenna 7 is inputted through the port 0, the microwave signal having various frequency components $f_1$ through $f_n$ is first inputted to the integral filter 4 through the circulator 1.

In the integral filter 4, the microwave signal at a frequency $f_1$ is branched to the port 1 and the microwave signal at a frequency $f_2$ is branched to the port 2 by the dielectric filter 4-1 having a pass frequency $f_1$ and the dielectric filter 4-2 having a pass frequency $f_2$, respectively.

The remaining microwave signals having frequencies excepting the frequencies $f_1$ and $f_2$ are reflected by the integral filter 4, outputted from the circulator 1, then inputted to the integral filter 5 via the circulator 2.

In the integral filter 5, the microwave signal at a frequency $f_3$ is branched to the port 3 and the microwave signal at a frequency $f_4$ is branched to the port 4 by the dielectric filter 5-1 having a pass frequency $f_3$ and the dielectric filter 5-2 having a pass frequency $f_4$, respectively. The remaining microwave signals having frequencies excepting the frequencies $f_1$ through $f_4$ are reflected by the integral filter 5, and outputted from the circulator 2. After that, a process of branching and reflecting the signal is repeated in the similar manner to the above, and the microwave signal is finally inputted to the integral filter 6 via the circulator 3.

In the integral filter 6, the microwave signal at a frequency $f_{n-1}$ is branched to the port n-1 and the microwave signal at a frequency $f_1$ is branched to the port n by the dielectric filter 6-1 having a pass frequency $f_{n-1}$ and the dielectric filter 6-2 having a pass frequency $f_n$, respectively.

Incidentally, the circulator 3 is terminated by the terminal resistor 8 so that wasteful reflection of the signal may be prevented.

The filter apparatus 10 for use in a radio apparatus described above has, as shown in FIG. 3, the integral filters 4 through 6 each of which includes a pair of the dielectric filters 11 and 12 having different frequencies, the integral filters 4 through 6 being, as shown in FIG. 1, connected to the common circulators 1 through 3, respectively. The above structure may reduce the number of the circulators and the boxes of the dielectric filters to a half, realize a reduction of size and a low cost of the filter apparatus 10 for use in a radio apparatus, and prevent attenuation of a signal generated when the signal passes through the circulators so as to accomplish highly accurate communication.

Alternatively, a pair of the dielectric filters 36 and 37 are connected to the common circulator 34 via the T-shaped branching unit 35, thereby reducing the number of the circulators to a half although the dielectric filters used in the general radio apparatus remain used, as shown in FIG. 10. This structure may also realize a reduction of size and a low cost of the filter apparatus 10 for use in a radio apparatus, and prevent attenuation of a radio transmitted-received signal occurring when the signal passes through the circulators so as to accomplish highly accurate communication.

As shown in FIG. 3, in each of the integral filters 4 through 6, the connecting rod 16 is used commonly by the dielectric filters 11 and 12 so as to readily realize integration of the filters although the structure of the connecting units between the integral filters 4 through 6 and the circulators 1 through 3 and a method for connecting the integral filters 4 through 6 to the circulators 1 through 3 remain similar to those of the general filters and circulators.

As shown in FIG. 9, it is possible to integrate the box 29 and the box 29 for the circulator in each of the integral filters 4 through 6 so as to integrate the circulator 30 and a pair of the dielectric filters 31 and 32, thereby forming the integral circulator-filter 33. This structure may omit a connector between the circulator 30 and the dielectric filters 31 and 32 so as to remove an insertion loss due to the connector.

As shown in FIG. 8, each of the integral filters 4 through 6 has the dielectric filter 21 formed by arranging the dielectrics 14 in a half portion of the box 13, and the remaining half portion is used as the unused part 22 which is vacant, thereby forming an integral filter for one channel. Even if the filter apparatus 10 for use in a radio apparatus shown in FIG. 1 has dielectric filters in odd numbers, it is possible to use the same box 13 as the integral filter for two channels.

In each of the integral filters 4 through 6, it is possible to employ a TE01δ mode dielectric filter which has a small loss of a high-frequency signal, and set a temperature coefficient (τf) at a resonance frequency of the dielectrics 14 and a thermal expansion coefficient of the box 13 so as to set a temperature coefficient of the filter to zero, thereby improving a branching property of the integral filter.

As shown in FIG. 7, in each of the integral filters 4 through 6, the L-shaped connecting members 39 as the end position input-output members are used and connected in the transversal direction of the box 13, thereby connecting other members constituting the radio apparatus in the vertical and transversal directions of the filter apparatus 10 for use in a radio apparatus.

The filter apparatus for use in a radio apparatus according to the embodiment of this invention may realize a cost reduction of 30% or more as compared with a filter apparatus having the general structure for use in a radio apparatus.

Figure 12:
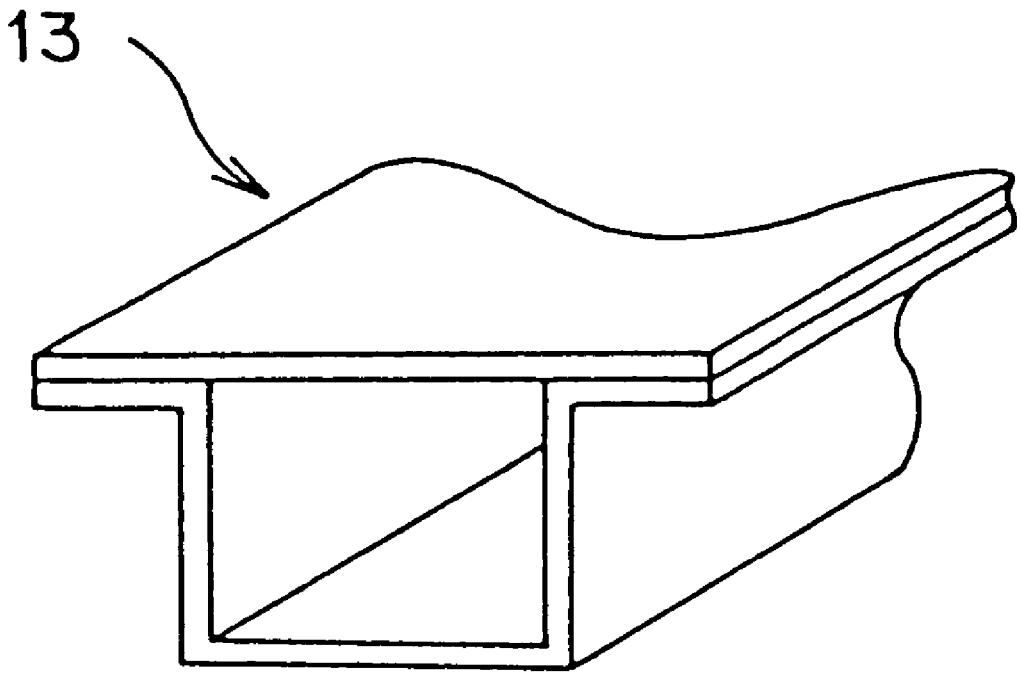
FIG. 12 is a perspective view of a part of the box according to the embodiment of this invention.
Figure 13:
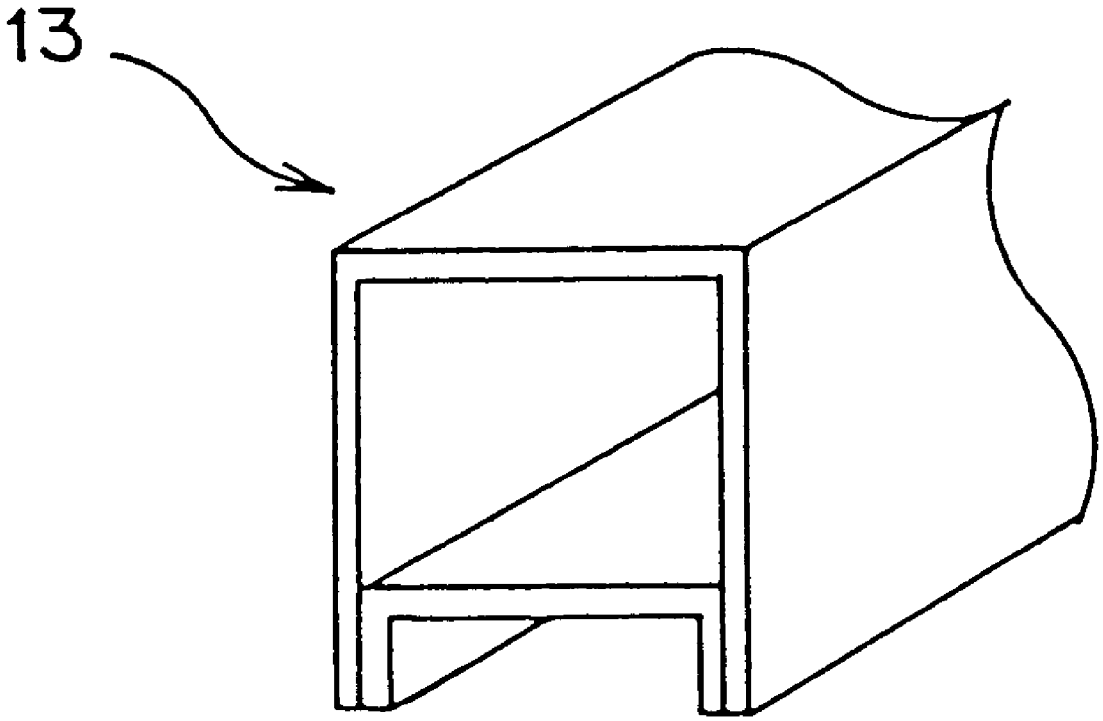
FIG. 13 is a perspective view of a part of the box according to the embodiment of this invention.

In the filter apparatus for use in a radio apparatus according to the embodiment of this invention, the box 13 forming each of the integral filters 4 through 6 is fabricated in cutting work. However, it is possible that the box 13 is formed with plates, as shown in FIGS. 12 and 13. The box 13 shown in FIG. 13 is so configured as to have a narrower width and a greater resistance to mechanical stress than the box 13 shown in FIG. 12.

Figure 11:
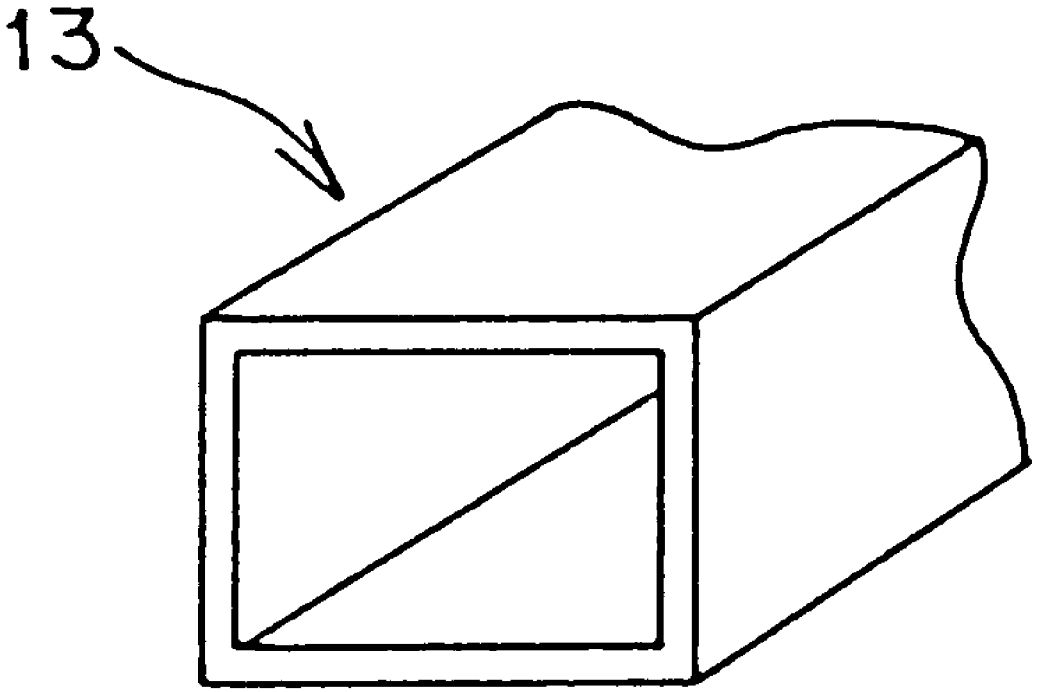
FIG. 11 is a perspective view of a part of a box according to the embodiment of this invention.

It is possible, as shown in FIG. 11, that the box 13 has a tubular shape. The box 13 having a tubular shape is formed with plates or fabricated in extruding work, thereby omitting a screw used when the cap member and the like are attached and reducing a volume of the box 13.

As above, use of any one of the boxes 13 shown in FIGS. 11 through 13 may largely reduce a cost of the box 13 so as to realize a low cost of the filter apparatus 10 for use in a radio apparatus as compared with use of a box fabricated in cutting work.

Figure 14:
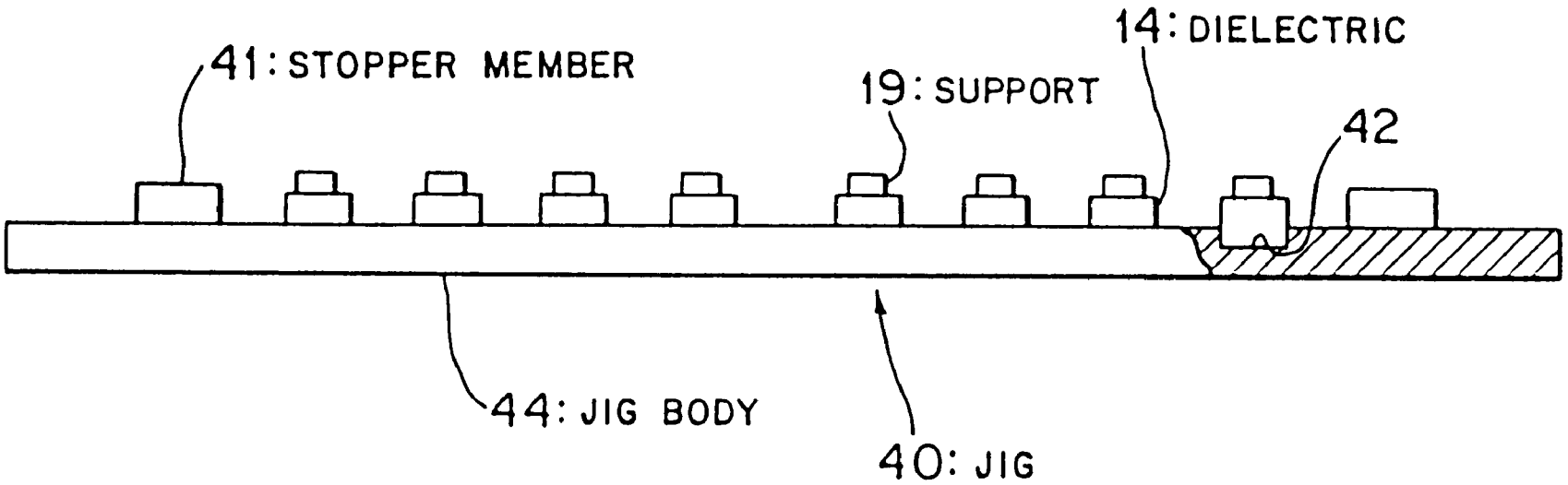
FIG. 14 is a side view, with a portion broken away, of a jig according to an embodiment of this invention.
Figure 15:
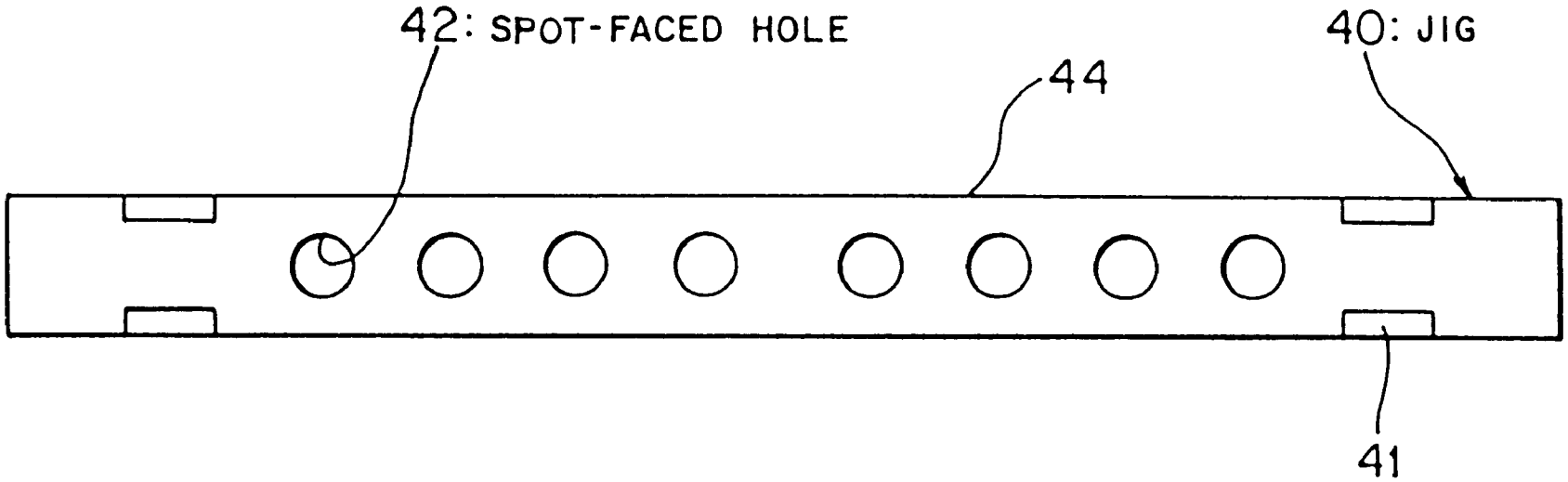
FIG. 15 is a front view of the jig according to the embodiment of this invention.
Figure 16:
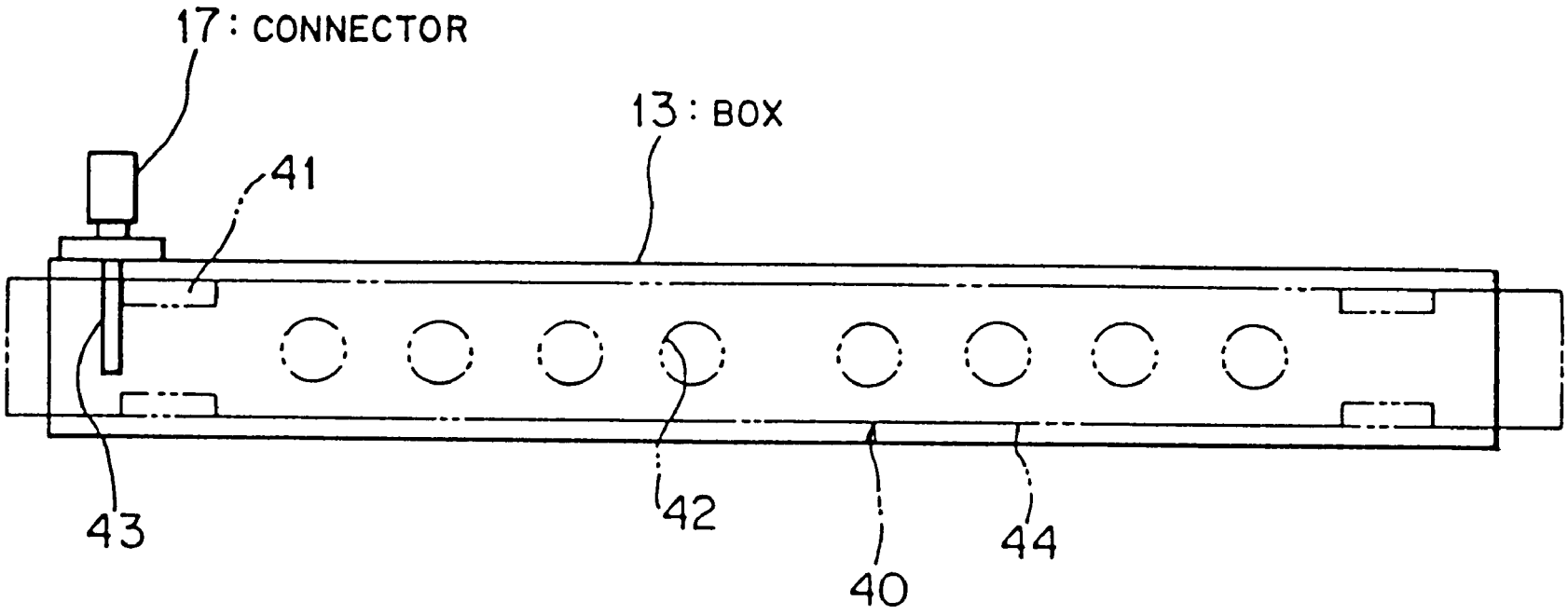
FIG. 16 illustrates a state where the jig is inserted into the box according to the embodiment of this invention.
Figure 17A:
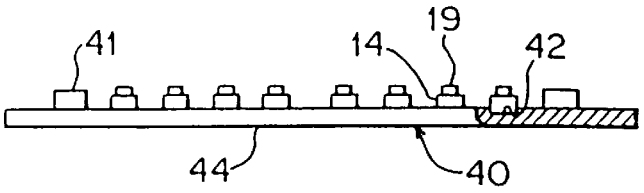
FIGS. 17(*a*) through 17(*g*) illustrate a technique of fabricating the dielectric filter according to the embodiment of this invention.
Figure 17B:
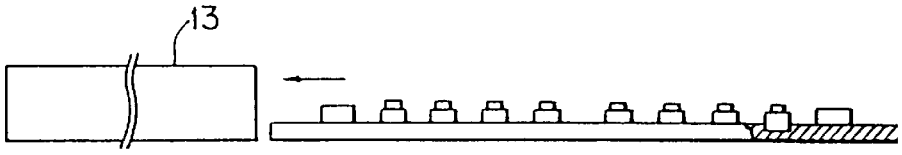
Figure 17C:
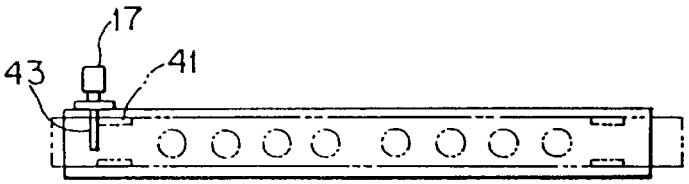
Figure 17D:
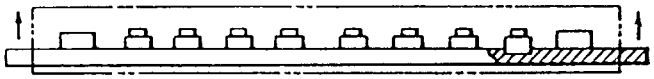
Figure 17E:
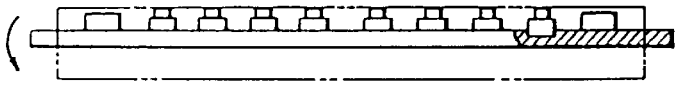
Figure 17F:
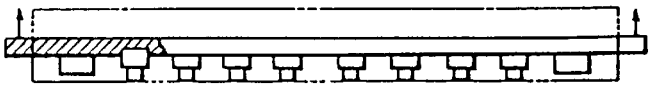
Figure 17G:
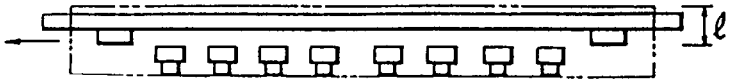
Figure 18:
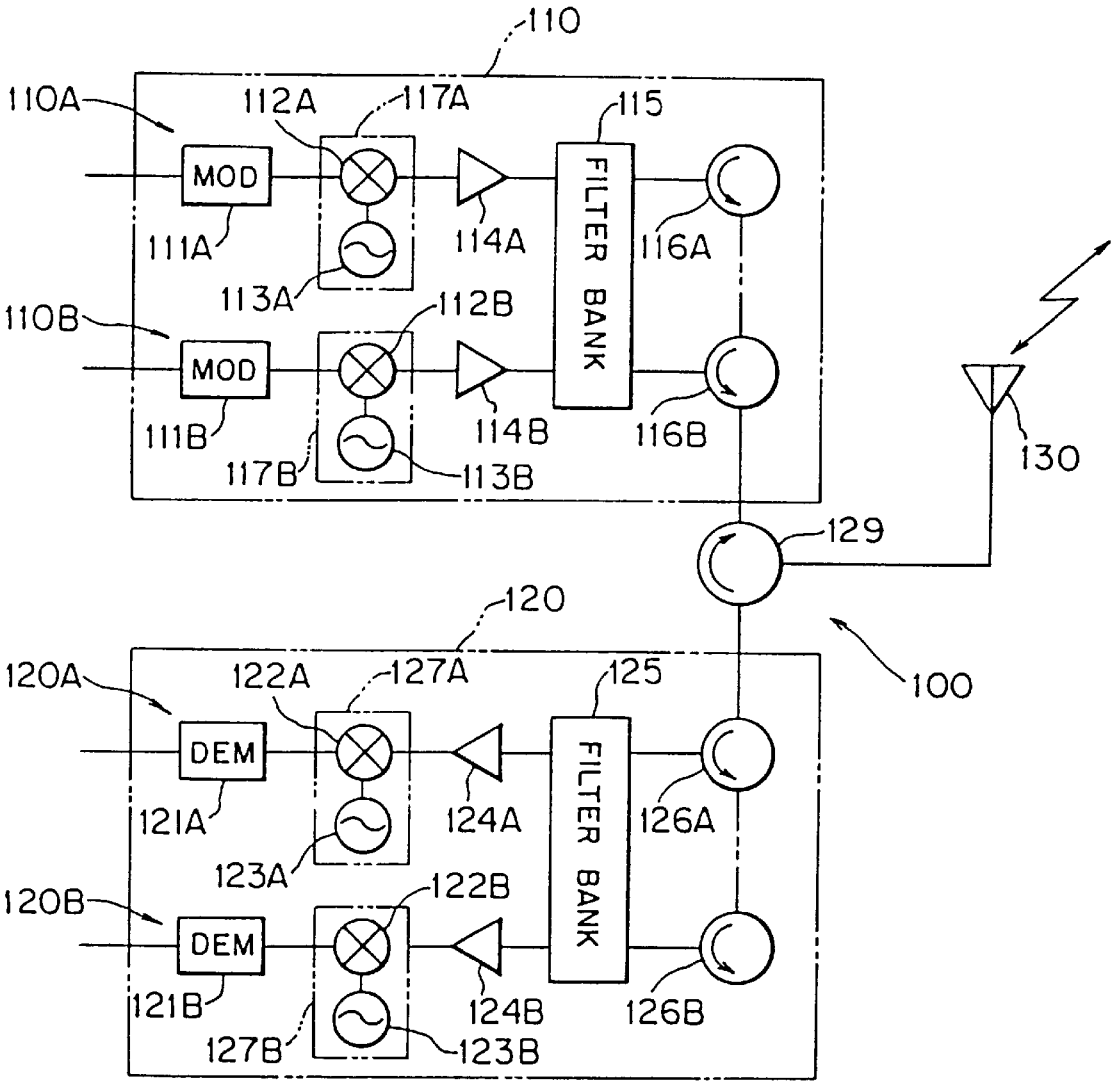
FIG. 18 RELATED ART
FIG. 18 is a block diagram showing a structure of a multiplex radio apparatus.
Figure 19:
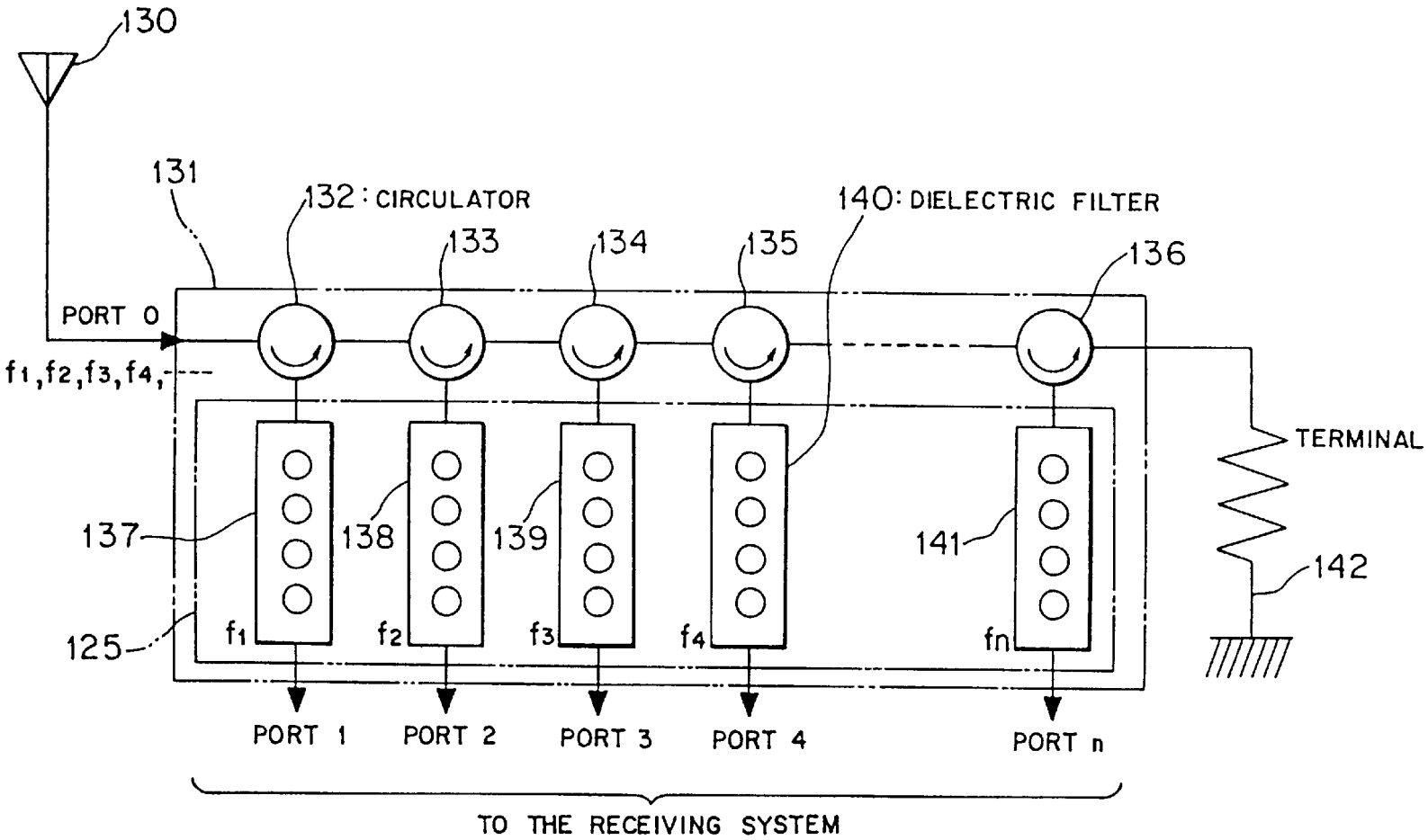
FIG. 19 RELATED ART
FIG. 19 shows a structure of a high-frequency receiving unit of a general multiplex radio apparatus.

Meanwhile, in each of the integral filters 4 through 6 using the box 13 having a tubular shape shown in FIG. 11, the box 13 is in a structure of a closed cross section. For this, a jig 40 shown in FIGS. 14 through 16 is used to arrange the dielectrics 14 within the box 13. FIG. 14 is a side view of the jig 40, FIG. 15 is a front view of the jig 40, and FIG. 16 shows the jig 40 slid into the box 13.

Here, the jig 40 is served to arrange plural (eight in FIG. 3, for example) dielectrics 14 within the box 13 of the filter apparatus 10 for use in a radio apparatus that should be provided with the integral filters 4 through 6 each of which is formed by arranging the plural dielectrics 14 (i.e., eight) at certain clearances in a substantially linear array within the box 13. To this end, the jig 40 has a jig body 44 slidable within the box 13 having a tubular shape, both ends of which are opened. In the jig body 44, plural spot-faced holes 42 as recesses on which the plural (eight) dielectrics are mounted are formed at certain clearances in a substantially linear array. In addition, the jig 40 further has a stopper member 41 which engages with an inner conductor 43 as a protruding member attached to the body 13 to position the jig 40.

Namely, the jig 40 is formed by mounting the dielectrics 14 and the supports 19 on the spot-faced holes 42 in order (the dielectrics 14 and the supports 19 are adhered with an adhesive, further the adhesive is applied on the upper surfaces of the supports 19), as shown in FIGS. 14 and 15. When the jig 40 is inserted into the box 13 and slidably moved within the box 13 as shown in FIG. 16, the stopper member 41 is caught by the inner conductor 43 connected to the connector 17 disposed on one side and stops thereat to place the dielectrics 14 in accurate positions, thereby fabricating the dielectric filters 4-1 through 6-2 having a high branching accuracy.

A thickness of the jig 40 is smaller than a clearance 1 [FIG. 17(*g*)] between the upper surfaces of the dielectrics 14 and a ceiling of the box 13 so that the jig 40 can be drawn out from the box 13.

If the dielectrics 14 of the filter apparatus 10 for use in a radio apparatus are arranged by using the jig having the above structure, it is necessary, to begin with, to prepare the jig 40 used to arrange the dielectrics 14 of the filter apparatus 10 for use in a radio apparatus. The spot-faced holes 42 as recesses on which plural (eight) dielectrics are mounted are formed at certain clearances in a substantially linear array in the jig body 40, which is slidable within the box 13, both ends of which are opened, forming the filter apparatus 10 for use in a radio apparatus. In addition, the jig 40 has the stopper member 41 engaging with the inner conductor 43 as a protruding member attached to the box 13 to position the jig 40 in order to arrange the plural (eight) dielectrics 14 within the box 13 of the filter apparatus 10 for use in a radio apparatus that should have the dielectric filters 4-1 through 6-2 formed by arranging the plural (eight) dielectrics 14 at certain clearances in a substantially linear array within the box 13.

Next, the jig 40 is inserted into the box 13, both ends of which are opened, in a state where the plural (eight) dielectrics 14 are mounted on the spot-faced holes 42 as recesses on which the plural (eight) dielectrics 14 are mounted formed in the jig body 40 of the jig 40. The jig 40 is then moved forward within the box 13 until the stopper member 41 of the jig 40 strikes into the inner conductor 43 as a protruding member attached to the box 13, and the box 40 is turned 180° in this condition to disconnect the dielectrics 14 from the body of the jig 40, whereby the plural (eight) dielectrics 14 may be arranged at certain clearances in a substantially linear array within the box 13.

Now, a method for arranging the dielectrics 14 will be described referring to FIGS. 17(*a*) through 17(*g*). As shown in FIG. 17(*a*), the dielectrics 14 and the supports 19 are mounted on the spot-faced holes 42 in order. The dielectrics 14 and the supports 19 are adhered with an adhesive, and the adhesive is applied on the upper surfaces of the supports 19.

When the jig 40 on which the dielectrics 14 and the supports 19 are mounted is inserted into the box 13 and slid within the box 13, as shown in FIG. 17(*b*), the stopper member 41 is caught by the inner conductor 43 connected to the connector 17 on one side so as to accurately determine positions in which the dielectrics 14 should be arranged, as shown in FIG. 17(*c*).

After the positioning, the jig 40 is lifted upward to adhere the box 13 to the supports 19 to which dielectrics 14 are adhered, as shown in FIG. 17(*d*). The box 13 and the jig 40 are then turned 180° together to securely fix the dielectrics 14 to the box 13, as shown in FIG. 17(*e*). After that, the jig 40 is raised upward within the box 13 as shown in FIG. 17(*f*) to disconnect the dielectrics 14 from the jig 40.

As shown in FIG. 17(*g*), the jig 40 is slid within the box 13 to be pulled out from the box 13.

Even if the integral filters 4 through 6 are formed with the boxes 13 each having a tubular shape and a small volume, it is possible to arrange the dielectrics 14 in precise positions so as to fabricate the dielectric filters 4-1 through 6-2 having a high branching accuracy.

What is claimed is:

1. A filter apparatus for use in a radio apparatus comprising:

a box having an oblong space therein;

a pair of dielectric filters formed in left and right portions of said box in each of which plural dielectrics are arranged in series at certain clearances in a substantially linear array, said pair of dielectric filters having different frequency characteristics and being disposed in a receiving system or a transmitting system;

a middle position input-output member protruding into the middle portion within said box and connected to a circulator common to said pair of dielectric filters; and end position input-output members protruding into end portions within said box.

2. The filter apparatus for use in a radio apparatus according to claim 1, wherein said box is structured as a box having a tubular shape.

3. The filter apparatus for use in a radio apparatus according to claim 2, wherein said box is formed with plates.

4. The filter apparatus for use in a radio apparatus according to claim 2, wherein said box is fabricated in extruding work.

5. The filter apparatus for use in a radio apparatus according to claim 1, wherein a temperature coefficient at a resonance frequency of said dielectrics and a thermal expansion coefficient of said box are so set as to set a temperature coefficient of a filter to zero.

6. The filter apparatus for use in a radio apparatus according to claim 1, wherein said circulator is integrally formed within said box; and said circulator having a plurality of terminals for input and output;

wherein at least one terminal protrudes externally from said box.

7. The filter apparatus for use in a radio apparatus according to claim 6, wherein said box has a tubular shape.

8. The filter apparatus for use in a radio apparatus according to claim 7, wherein said box is formed with plates.

9. The filter apparatus for use in a radio apparatus according to claim 7, wherein said box is fabricated in extruding work.

10. The filter apparatus for use in a radio apparatus according to claim 1, wherein said dielectric filters are TE01δ mode dielectric filters.

11. The filter apparatus for use in a radio apparatus according to claim 1, wherein said middle position input-output member is a connecting rod of an open probe.

12. The filter apparatus for use in a radio apparatus according to claim 1, wherein each of said end position input-output members is a connecting rod of an open probe.

13. The filter apparatus for use in a radio apparatus according to claim 1, wherein said end position input-output members are L-shaped connecting members.

14. A filter apparatus for use in a radio apparatus comprising:

a box having an oblong space therein;

a dielectric filter formed in only a half portion of said box in which plural dielectrics are arranged in series at certain clearances in a substantially linear array so that the other half portion of said box remains unused, said dielectric filter being disposed in a receiving system or a transmitting system;

a middle position input-output member protruding into a middle portion within said box and connected to a circulator; and an end position input-output member protruding into an end portion of said half portion within said box.

15. The filter apparatus for use in a radio apparatus according to claim 14, wherein said box is structured as a box having a tubular shape.

16. The filter apparatus for use in a radio apparatus according to claim 15, wherein said box is formed with plates.

17. The filter apparatus for use in a radio apparatus according to claim 15, wherein said box is fabricated in extruding work.

18. The filter apparatus for use in a radio apparatus according to claim 14, wherein a temperature coefficient at a resonance frequency of said dielectrics and a thermal expansion coefficient of said box are so set as to set a temperature coefficient of a filter to zero.

19. The filter apparatus for use in a radio apparatus according to claim 14, wherein said dielectric filter is a TE01δ mode dielectric filter.

20. The filter apparatus for use in a radio apparatus according to claim 14, wherein said middle position input-output member is a connecting rod of an open probe.

21. The filter apparatus for use in a radio apparatus according to claim 14, wherein said end position input-output member is a connecting rod of an open probe.

22. The filter apparatus for use in a radio apparatus according to claim 14, wherein said end position input-output member is an L-shaped connecting member.

* * * * *